US007693435B2

(12) United States Patent
Moriguchi et al.

(10) Patent No.: US 7,693,435 B2
(45) Date of Patent: Apr. 6, 2010

(54) FIXING DEVICE AND IMAGE FORMING APPARATUS

(75) Inventors: Motoki Moriguchi, Osaka (JP); Yuzuru Nanjo, Osaka (JP)

(73) Assignee: Kyocera Mita Corporation (JP)

( * ) Notice: Subject to any disclaimer, the term of this patent is extended or adjusted under 35 U.S.C. 154(b) by 539 days.

(21) Appl. No.: 11/701,676

(22) Filed: Feb. 2, 2007

(65) Prior Publication Data

US 2007/0183798 A1 Aug. 9, 2007

(30) Foreign Application Priority Data

Feb. 7, 2006 (JP) ..... 2006-030199

(51) Int. Cl.
*G03G 15/20* (2006.01)

(52) U.S. Cl. ..... 399/33; 399/69; 399/329

(58) Field of Classification Search ..... 399/33, 399/329, 69; 219/216, 469–471
See application file for complete search history.

(56) References Cited

U.S. PATENT DOCUMENTS

| | | | | |
|---|---|---|---|---|
| 4,272,666 | A * | 6/1981 | Collin | 219/216 |
| 4,585,325 | A * | 4/1986 | Euler | 399/69 |
| 6,006,051 | A * | 12/1999 | Tomita et al. | 399/69 |
| 6,055,390 | A | 4/2000 | Kurotaka et al. | |
| 6,636,709 | B2 | 10/2003 | Furukawa et al. | |
| 7,009,153 | B2 | 3/2006 | Tomatsu | |
| 2005/0135820 | A1 | 6/2005 | Morihara et al. | |
| 2005/0220507 | A1 * | 10/2005 | Uehara et al. | 399/329 |
| 2006/0093411 | A1 * | 5/2006 | Watanabe et al. | 399/329 |
| 2009/0060549 | A1 * | 3/2009 | Ahn | 399/69 |

FOREIGN PATENT DOCUMENTS

| | | |
|---|---|---|
| CN | 1202641 | 12/1998 |
| CN | 1521578 | 8/2004 |
| JP | 2002-82571 | 3/2002 |
| JP | 2004354521 | 12/2004 |
| JP | 2005037858 | 2/2005 |
| JP | 2005-181875 | 7/2005 |

* cited by examiner

*Primary Examiner*—Susan S Lee
(74) *Attorney, Agent, or Firm*—Gerald E. Hespos; Anthony J. Casella

(57) ABSTRACT

A fixing device has a heating roller with a heat source therein. A power supply operates the heat source for heating a transfer material and fixing a toner image thereon. A pressure roller is spaced from the heating roller and a facing member faces the heating roller. An endless fixing belt is mounted on the facing member and the heating roller and contacts the pressure roller to form a nip. A temperature detector faces the outer surface of the fixing belt for detecting the surface temperature thereof. An excessive temperature preventer faces part of the outer surface of the heating roller where the fixing belt is not mounted for detecting the surface temperature of the heating roller and cutting off the power supply to the heat source when the surface temperature rises above a preset temperature.

20 Claims, 9 Drawing Sheets

FIXING DEVICE AND IMAGE FORMING APPARATUS

BACKGROUND OF THE INVENTION

1. Field of the Invention

The present invention relates to a fixing device for fixing a toner image transferred to a transfer material and an image forming apparatus employing such a fixing device.

2. Description of the Related Art

A fixing device as disclosed in Japanese Unexamined Patent Publication No. 2002-82571 has been conventionally known. This fixing device is arranged at a side immediately downstream of an image forming assembly in an image forming apparatus and fixes a toner image transferred to a sheet (transfer material) in the image forming assembly to this sheet by heating, i.e. applies a so-called image fixing operation. Such a fixing device includes a heating roller provided with a heat source inside, a fixing roller opposed to this heating roller and a fixing belt mounted between the fixing roller and the heating roller. There is also provided a pressure roller to be pressed into contact with the fixing roller with the fixing belt therebetween.

The sheet having the toner image transferred thereto is fed to a nip portion formed between the pressure roller rotating about its central axis and the fixing belt turning between the heating roller and the fixing roller. Upon passing the nip portion, toner particles are melted by supplying heat from the fixing belt to the sheet, and the image fixing operation is performed by fixing the melted toner particles to the surface of the sheet.

In such a fixing device, the temperature of the fixing belt needs to be properly controlled. To this end, a temperature sensor is arranged at a position facing part of the outer circumferential surface of the heating roller where the fixing belt is not mounted, and the temperature of the fixing belt is controlled to a specified temperature based on the detection result of this temperature sensor.

In the operation of fixing the toner particles to the sheet, temperature at the outer surface of the fixing belt to be directly brought into contact with the toner particles influence the quality (fixing property) of the image fixing operation. However, immediately after the warm-up following the start of the image forming apparatus, the outer surface of the fixing belt has not yet reached the specified temperature in many cases. If the sheet is passed through the nip portion in such a state, the temperature at the outer surface of the fixing belt falls to or below a specified temperature, thereby causing inconvenience of deteriorating the fixing property.

Even if sufficient time passes after the warm-up and the fixing belt is uniformly heated up to the specified temperature, the fixing property is deteriorated in some cases. For example, if a large number of sheets are successively fed to the nip portion per unit time, the outer surface of the fixing belt is deprived of a large quantity of heat. A resulting fall in the surface temperature of the fixing belt may deteriorate the fixing property of the toner particles.

In order to avoid such inconvenience, the temperature sensor (temperature detecting means) is arranged at the position facing the part of the outer circumferential surface of the heating roller where the fixing belt is not mounted in the fixing device of the above patent publication, and the temperature of the fixing belt is controlled to the specified temperature based on the detection result of this temperature sensor. However, the temperature on the outer circumferential surface of the heating roller does not necessarily correspond to the temperature at the outer surface of the fixing belt upon the occurrence of the above inconvenience. This leads to a problem that the surface temperature of the fixing belt cannot be properly controlled and the fixing property of the toner particles is deteriorated in some cases.

In the fixing device of the above patent publication, the heating roller might be overheated if the temperature sensor cannot precisely detect temperature for a certain reason or a control circuit is in trouble.

SUMMARY OF THE INVENTION

An object of the present invention is to provide a fixing device and an image forming apparatus in which the surface of a fixing belt can be constantly properly detected and there is no likelihood of overheating a heating roller.

In order to accomplish this object, one aspect of the present invention is directed to a fixing device for fixing a toner image by giving heat to a transfer material having the toner image transferred thereto, comprising a heat source for generating heat upon receiving the supply of power; a heating roller having the heat source mounted therein; a pressure roller disposed at a specified distance to the heating roller; a facing member disposed to face the heating roller; an endless fixing belt mounted on the facing member and the heating roller and pressed into contact with the pressure roller to form a nip portion; a temperature detecting member disposed to face the outer surface of the fixing belt for the detection of the surface temperature of the fixing belt; and an excessive temperature increase preventing member disposed to face a part of the outer circumferential surface of the heating roller where the fixing belt is not mounted for detecting the surface temperature of the heating roller and cutting off the power supply to the heat source when the surface temperature rises to or above a preset temperature.

Another aspect of the present invention is directed to an image forming apparatus, comprising an image forming unit for performing an operation of transferring a toner image to a transfer material, and a fixing unit for fixing the toner image by giving heat to the transfer material, the fixing unit having the construction of the inventive fixing device.

DETAILED DESCRIPTION OF THE PREFERRED EMBODIMENTS

Figure 1:
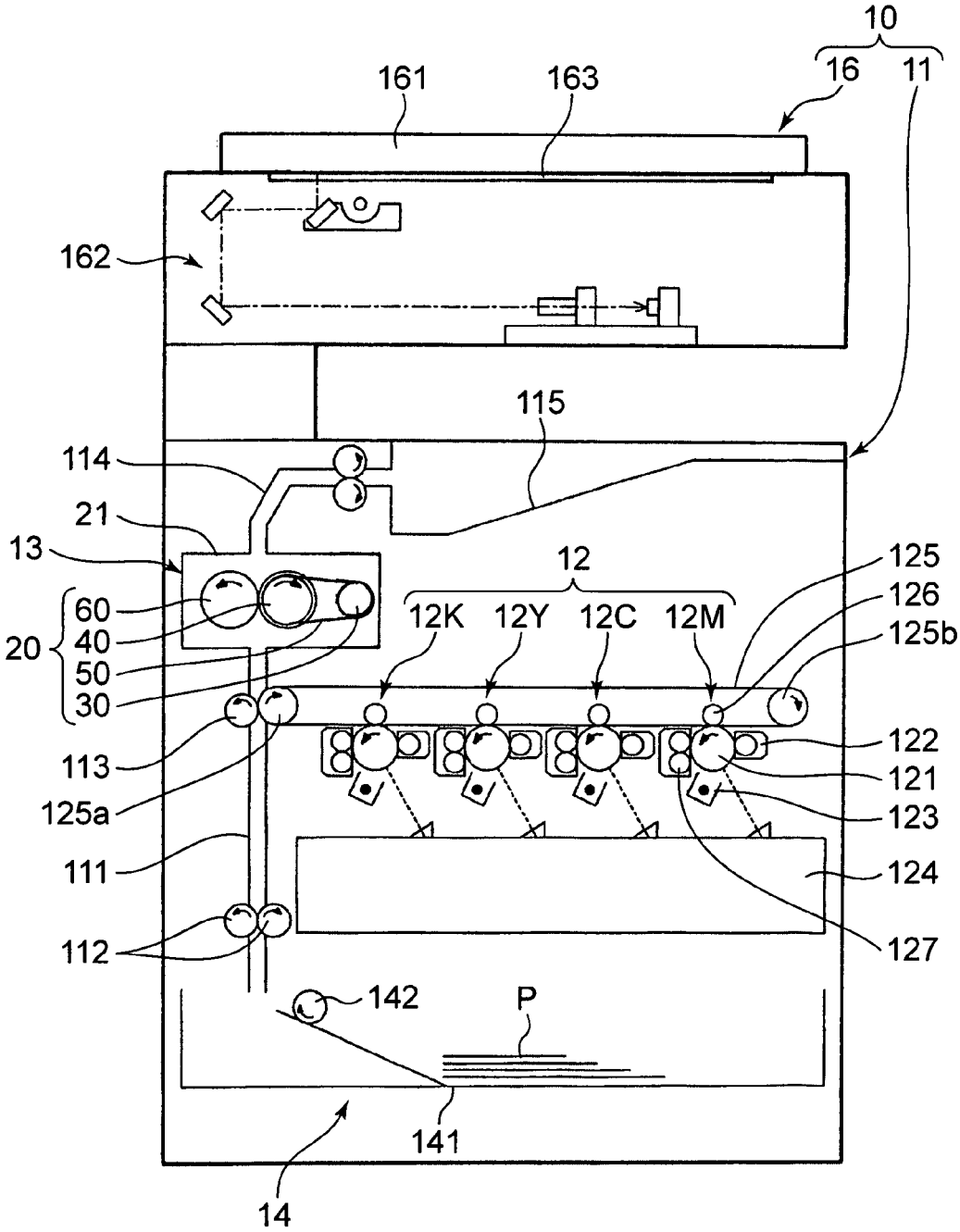
FIG. 1 is a front view in section showing the internal construction of an image forming apparatus according to one embodiment of the invention.

First, an image forming apparatus provided with a fixing device according to the present invention is outlined with reference to FIG. 1. FIG. 1 is a front view in section showing one embodiment of the internal construction of the image forming apparatus. The image forming apparatus 10 is used as a color copier and has a basic construction provided with a box-shaped apparatus main body 11 referred to as an internal sheet discharging type, and an image reader 16 arranged atop the apparatus main body 11 for reading a document image.

An image forming assembly 12 for forming an image based on the image information of a document read by the image reader 16, a fixing assembly 13 for fixing an image formed by the image forming assembly 12 and transferred to a sheet (transfer material) P, and a sheet storing assembly 14 for storing sheets used for image transfer are installed in the apparatus main body 11.

The image reader 16 includes a document pressing member 161 openably and closably provided on the upper surface of the apparatus main body 11, and an optical unit 162 arranged in a casing above the apparatus main body 11 in such a manner as to face the document pressing member 161 via a contact glass 163. The contact glass 163 is dimensioned to have a planar shape slightly smaller than the document pressing member 161 to read a document surface of a document placed thereon. The document pressing member 161 is made openable and closable by rotating back and forth about a specified shaft provided at one side of the upper surface of the casing accommodating the optical unit 162.

An unillustrated operation panel operated to enter process conditions relating to the document reading and the copying operation is provided at a specified position of the image reader 16. Unillustrated display panel, numerical pad, start button, mode changeover key and the like are arranged on this operation panel.

The optical unit 162 includes a light source, mirrors, lens unit and CCD (charge-coupled device) and the like. A light emitted from the light source is reflected by the document surface, and this reflected light is guided to the CCD as document information via the mirrors and the lens unit. A document information signal as an analog quantity outputted from the CCD is saved in a specified storage device after being converted into a digital signal.

The image forming assembly 12 is for forming a toner image on a sheet fed from the sheet storing assembly 14 and includes a magenta image forming unit 12M, a cyan image forming unit 12C, a yellow image forming unit 12Y and a black image forming unit 12K in this order from an upstream side (right side in the plane of FIG. 1) to a downstream side in this embodiment.

Each of the units 12M, 12C, 12Y, 12K includes a photoconductive drum 121 and a developing device 122. Each photoconductive drum 121 receives the supply of toner particles from the corresponding developing device 122 while being rotated in counterclockwise direction in FIG. 1. Toner particles are supplied from unillustrated toner cartridges arranged at the front side (front side of the plane of FIG. 1) of the apparatus main body 11 to the respective developing devices 122.

A charger 123 is disposed at a position right below each photoconductive drum 121. An exposing device 124 is disposed at a position below the charger 123. Each photoconductive drum 121 has the outer circumferential surface thereof uniformly charged by the corresponding charger 123. Laser beams corresponding to the respective colors and based on an image data inputted from the image reader 16 are emitted to the charged outer circumferential surfaces of the photoconductive drums 121. Electrostatic latent images are formed on the outer circumferential surfaces of the photoconductive drums 121 by these operations. The toner particles are supplied from the developing devices 122 to such electrostatic latent images, thereby forming toner images on the outer circumferential surfaces of the photoconductive drums 121.

A transfer belt 125 mounted on a drive roller 125*a* and a driven roller 125*b* in such a manner as to touch the outer circumferential surfaces of the respective photoconductive drums 121 is arranged above the photoconductive drums 121. This transfer belt 125 turns between the drive roller 125*a* and the driven roller 125*b* in synchronism with the respective photoconductive drums 121 while being pressed against the outer circumferential surfaces of the photoconductive drums 121 by transfer rollers 126 disposed in correspondence with the photoconductive drums 121.

As the transfer belt 125 is turned, the magenta toner image is transferred to the outer surface of the transfer belt 125 by the photoconductive drum 121 of the magenta unit 12M. Subsequently, the cyan toner image, the yellow toner image and the black toner image are successively transferred to the same position of the transfer belt 125 in a superimposed manner by the photoconductive drums 121 of the cyan unit 12C, the yellow unit 12Y and the black unit 12K. In this way, a color toner image is formed on the outer surface of the transfer belt 125. The color toner image formed on the outer surface of the transfer belt 125 is transferred to a sheet P conveyed from the sheet storing assembly 14.

A cleaning device 127 for cleaning the outer circumferential surface of the photoconductive drum 121 by removing the residual toner particles is disposed at a position to the left of each photoconductive drum 121 in FIG. 1. The outer circumferential surface of each photoconductive drum 121 cleaned by the corresponding cleaning device 127 is moved toward the position of the corresponding charger 123 for a new charging operation.

The waste toner particles removed from the outer circumferential surface of each photoconductive drum 121 by the corresponding cleaning device 127 is collected into a corresponding unillustrated toner collection bottle through a specified path to be stored therein.

A vertically extending feeding conveyance path 111 is formed at a position to the left of the image forming assembly 12 in FIG. 1. A pair of conveyance rollers 112 are provided at a specified position of this feeding conveyance path 111, and a sheet from the sheet storing assembly 14 is conveyed toward the transfer belt 125 mounted on the drive roller 125*a* by driving the pair of conveyance rollers 112. A second transfer roller 113 held in contact with the outer surface of the transfer belt 125 is disposed on such a feeding conveyance path 111 at a position facing the drive roller 125*a*, and the color toner image on the transfer belt 125 is transferred to the sheet P being conveyed along the feeding conveyance path 111 and pressingly held between the transfer belt 125 and the second transfer roller 113.

The fixing assembly 13 is for fixing the toner image transferred to the sheet in the image forming assembly 12 and is provided with a fixing device 20. The fixing device 20 includes a heating roller 30 having a halogen lamp 33 (heat source) as an electric heating element built therein, a fixing roller 40 (facing member) disposed to face the heating roller 30, a fixing belt 50 mounted between the fixing roller 40 and the heating roller 30, and a pressure roller 60 disposed at a specified distance from the heating roller 30 to face the fixing roller 40 via the fixing belt 50. The fixing device 20 is described in detail later with reference to FIGS. 2 to 4.

The sheet P bearing the color image after the image fixing operation is discharged to an internal discharge tray 115 provided in the apparatus main body 11 through a discharging conveyance path 114 extending upward from the fixing assembly 13.

The sheet storing assembly 14 includes a sheet tray 141 detachably mountable into the apparatus main body 11 at a position below the exposing devices 124. A stack of sheets are stored in the sheet tray 141. Sheets P are dispensed one by one from the sheet stack stored in the sheet tray 141 by driving a pickup roller 142 and fed to a nip portion between the second transfer roller 113 of the image forming assembly 12 and the transfer belt 125 through the sheet conveyance path 111.

Figure 2:
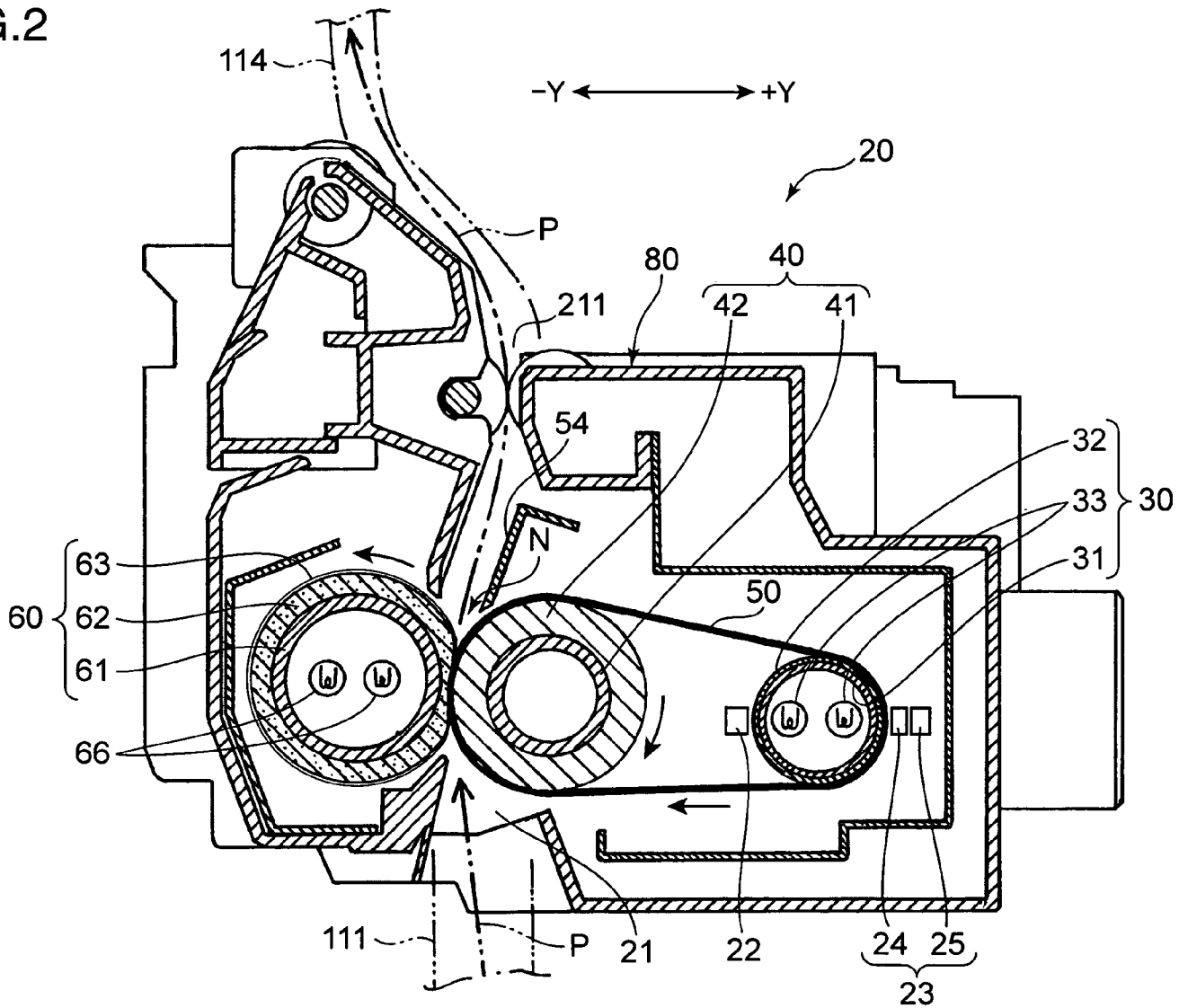
FIG. 2 is a front view in section outlining a fixing device according to the embodiment of the present invention.

FIG. 2 is a front view in section outlining one embodiment of the fixing device 20. It should be noted that Y-Y directions in FIG. 2 are forward and backward directions with −Y direction being forward direction and +Y direction being backward direction. The fixing device 20 is constructed by installing the heating roller 30, the fixing roller 40 disposed to face this heating roller 30, the fixing belt 50 mounted on the fixing roller 40 and the heating roller 30, and the pressure roller 60 disposed to face the fixing roller 40 via the fixing belt 50 in a container 80 in the form of a box having an irregular shape.

An introducing port 21 for introducing the sheet P conveyed via the sheet conveyance path 111 into the fixing device 20 is formed at a position of the bottom plate of the casing 80 in the vicinity of the bottom of the fixing roller 40. A discharge port 211 for discharging the sheet P finished with the image fixing operation is formed at a position of the ceiling plate of the casing 80 facing the introducing port 21.

The heating roller 30 is so disposed as to extend in sheet width direction normal to sheet conveyance direction at a backward position in the casing 80 in FIG. 2. The heating roller 31 has a cylindrical tubular shaft 31 made of aluminum or iron and rotatably supported in the casing 80. The outer circumferential surface of this tubular shaft 31 is coated with a fluoroplastic layer 32 by applying fluoroplastic such as PTFE (polytetrafluoroethylene) or PFA (tetrafluoroethylene-perfluoroalkyl vinyl ether copolymer). A fluoroplastic tube may be mounted on the tubular shaft 31 instead of coating. The halogen lamp 33 as a heat source for generating heat upon receiving the power supply is provided in the tubular shaft 31. The fixing belt 50 is mounted on the tubular shaft 31 of the heating roller 30.

For example, the thickness of the fluoroplastic layer 32 can be set to 30 μm. Of course, this thickness may be set at a value other than 30 μm and may be suitably set depending on the situation.

The fixing roller 40 is disposed before the heating roller 30 such that the center of rotation thereof is slightly displaced backward from the introducing port 21 in the casing 80 and the outer circumferential surface thereof faces that of the heating roller 30. The fixing roller 40 includes a fixing roller core 41 made of a metal material such as aluminum alloy or plated iron, and a cylindrical elastic tubular member 42 concentrically and integrally mounted on this fixing roller core 41 and made of synthetic resin foam such as silicon rubber foam.

Figure 5A:
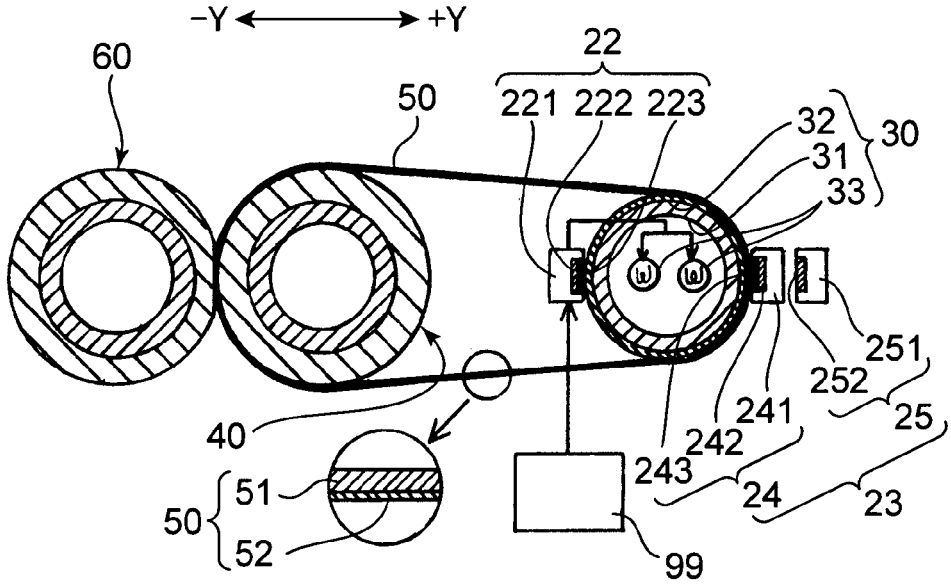
FIGS. 5A and 5B are respectively a front view in section and a perspective view partly cut away showing one embodiment of a mounted state of a thermostat and temperature sensors in the fixing device.

The fixing belt 50 is mounted on the tubular shaft 31 of the heating roller 30 and the elastic tubular member 42 of the fixing roller 40 with a specified tension applied thereto. In this embodiment, the fixing belt 50 is comprised of a nickel electroformed belt 51 and a silicon rubber layer 52 formed on the outer surface of this nickel electroformed belt 51 as shown in FIG. 5A, which is referred to later.

For example, the thickness of the nickel electroformed belt 51 can be set to 30 μm and that of the silicon rubber layer 52 can be set to 200 to 300 μm. These thicknesses can be suitably set depending on the situation.

Instead of the nickel-made electroformed belt 51, a belt made of a heat resistant tough synthetic resin material such as polyimide may, for example, be used. In the case of employing the polyimide belt, the thickness thereof is set at, e.g. 90 μm. Instead of the silicon rubber layer 52, a layer made of fluoroplastic such as PFA or PTFE may be employed as the layer formed on the electroformed belt 51.

The pressure roller 60 is arranged such that the center of rotation thereof is slightly before the introducing port 21 in the casing 80 and the outer circumferential surface thereof is held in contact with that of the fixing roller 40 via the fixing belt 50. The pressure roller 60 includes a pressure roller main body 61, which is a tubular body made of aluminum alloy or plated iron, a cylindrical elastic tubular member 62 made of silicon rubber and concentrically and integrally fitted on the pressure roller main body 61, and a fluoroplastic layer 63 made of PFA or the like and coated on the outer circumferential surface of the elastic tubular member 62. A halogen lamp 66 as a heat source is built in the pressure roller main body 61, and the toner particles on the sheet P are also fixed by heat from this halogen lamp 66.

A nip portion N for nipping the sheet P fed into the casing 80 through the introducing port 21 is formed at a contact position of the outer circumferential surface of the elastic tubular member 62 with that of the elastic tubular member 42 via the fluoroplastic layer 63 and the fixing belt 50, i.e. at a position where the fixing belt 50 and the fluoroplastic layer 63 are in contact.

The pressure roller main body 61 is made of the metal material such as aluminum alloy, whereas the elastic tubular member 62 is made of the elastic material such as silicon rubber. Thus, the pressure roller 60 can undergo such an elastic deformation as to be dented in radial direction by the contact with the fixing roller 40 via the fixing belt 50 in the nip portion N.

The pressure roller 60 is driven to rotate about its central axis by the transmission of a driving force of an unillustrated drive motor disposed at a specified position in the casing 80 to the pressure roller main body 61 via a deceleration mechanism. The driving rotation of the pressure roller 60 is transmitted to the fixing belt 50 held in pressing contact with the pressure roller 60. In this way, the fixing belt 50 turns between the heating roller 30 and the fixing roller 40. The fixing belt 50 is entirely heated by the heat transfer from the tubular shaft 31 of the heating roller 30 heated by radiant heat from the halogen lamp 33 while making a turning movement.

A separating plate 54 is disposed at the side of a position right above the nip portion N toward the fixing roller 40. The separating plate 54 is disposed such that the bottom edge thereof is in contact with the outer surface of the fixing belt 50 or at a very short distance to the outer surface of the fixing belt 50 although being not in contact therewith. The separating plate 54 is for separating the sheet P attached to the outer surface of the fixing belt 50 after the passing the nip portion N from the fixing belt 50.

The sheet P having the toner image transferred thereto is fed to the nip portion N between the pressure roller 60 and the fixing belt 50 mounted on the fixing roller 40 through the introducing port 21, and passes the nip portion N by the rotation of the pressure roller 60 and the turning movement of the fixing belt 50. Upon passing the nip portion N, the toner image is fixed to the sheet P by a heating process resulting from the transfer of the heat of the fixing belt 50 to the toner image on the front side of the sheet P.

The sheet P after the image fixing operation is discharged from the casing 80 through the discharge port 211 according to the pressure roller 60 about its central axis and the accompanying rotation of the turning movement of the fixing belt 50, and further discharged to the internal discharge tray 115 (see FIG. 1) through the discharging conveyance path 114.

Figure 3:
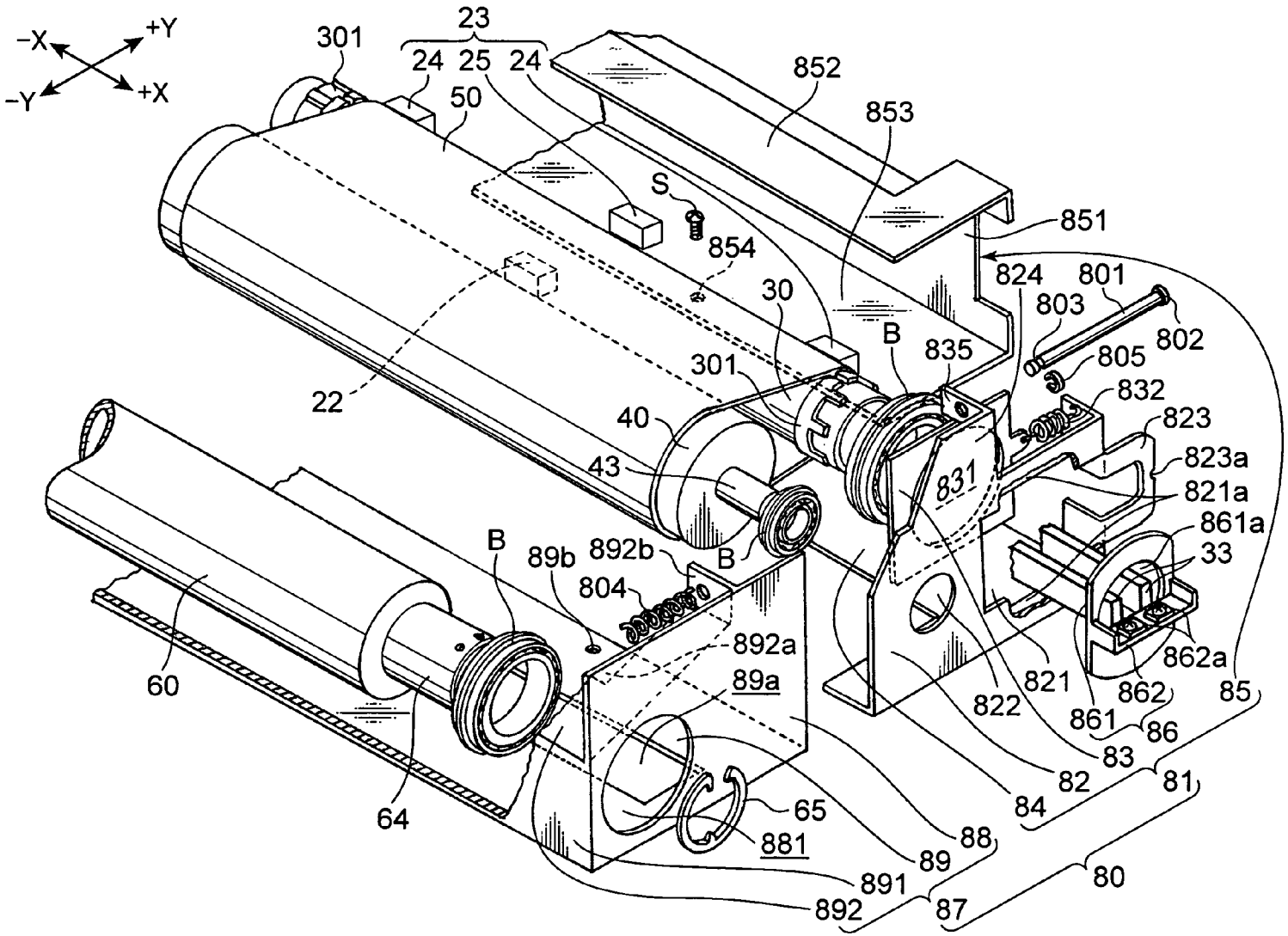
FIG. 3 is an exploded perspective view of the fixing device.
Figure 4:
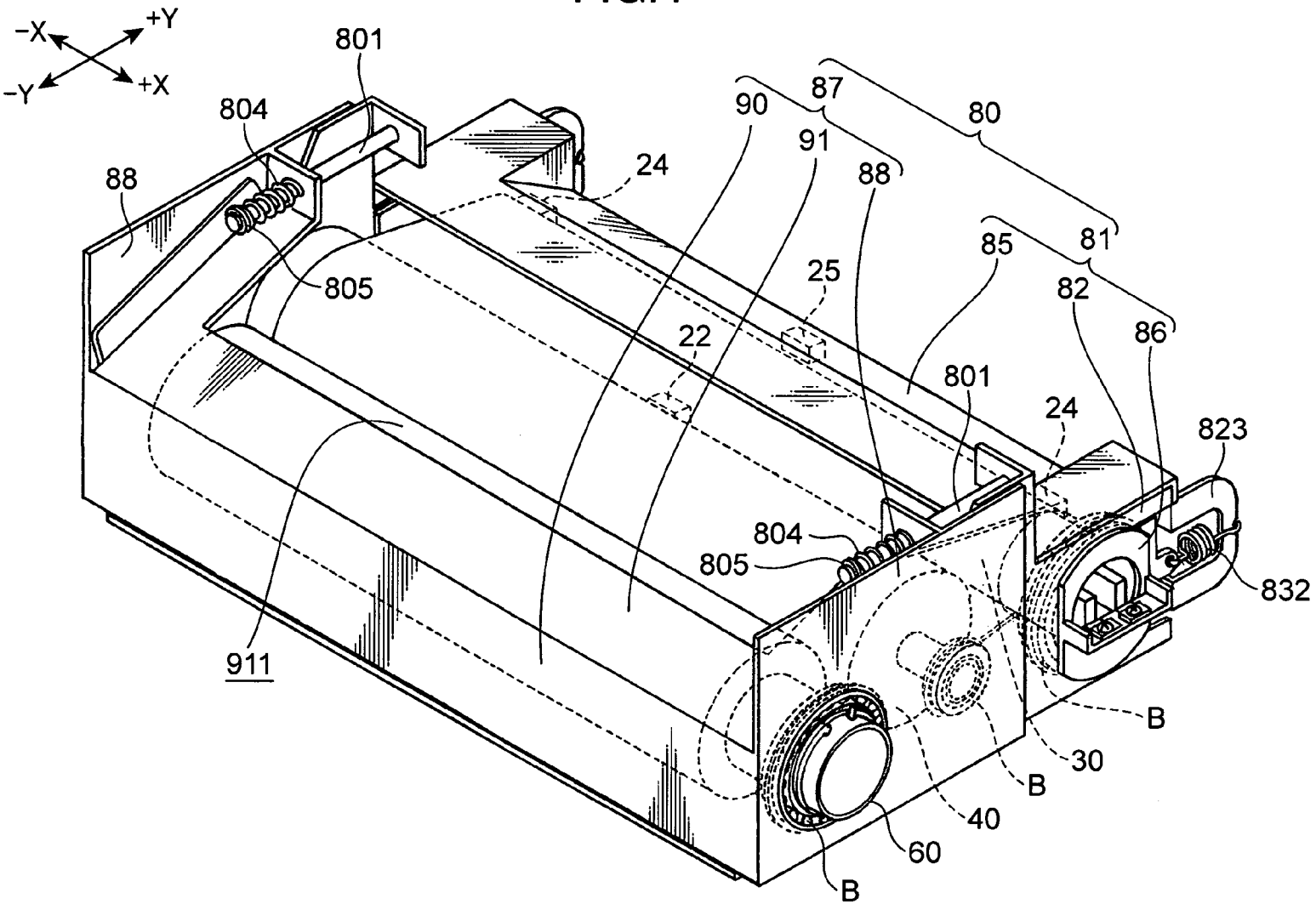
FIG. 4 is an assembled perspective view of the fixing device shown in FIG. 3.

The casing 80 in which the heating roller 30, the fixing roller 40 and the pressure roller 60 are mounted is described below with reference to FIGS. 3 and 4. FIG. 3 is an exploded perspective view of the casing 80 and FIG. 4 is an assembled perspective view thereof. It should be noted that, in FIGS. 3, 4, X-X directions and Y-Y directions are referred to as transverse directions and forward and backward directions, respectively, wherein −X direction is leftward direction, +X direction rightward direction, −Y direction forward direction and +Y direction backward direction. In FIGS. 3, 4, the casing 80 is simplified so as to be easily understandable and, accordingly, some of detailed design matters are either not shown or arranged. Further, in FIG. 3, only the right side of the casing 80 is shown and the symmetrically formed left side is not shown because the limited possibility of graphical representation on the plane.

As shown in FIG. 3, the casing 80 has a basic construction provided with a fixing-belt side casing 81 in which the heating roller 30, the fixing roller 40 and the fixing belt 50 are mounted, and a pressure-roller side casing 87 opposed to the fixing-belt side casing 81 while carrying the pressure roller 60.

The fixing-belt side casing 81 has a pair of side plates 82, a pair of movable plates 83, a laying plate 84, a cover member 85 and terminal mount members 86. The pair of side plates 82 are arranged to face the respective lateral ends of the fixing belt 50 mounted on the heating roller 30 and the fixing roller 40. The pair of movable plates 83 are horizontally movable along the respective side plates 82 while supporting the heating roller 30. The laying plate 84 spans between the bottom edges of the pair of side plates 82. The cover member 85 is mounted at positions corresponding to upper, rear and lower sides of the heating roller 30 between the pair of side plates 82, and is U-shaped in side view. The terminal mount members 86 are members for relaying power supplied to the halogen lamp 33.

Each side plate 82 is formed with a rectangular hole 821 facing an end of the heating roller 30 at a position of the rear half thereof and with a bearing mount hole 822 facing the fixing roller 40 at a position in the front half thereof. Each side plate 82 has a bracket 823 extending backward from a back position of the rectangular hole 821, and a projecting plate 824 projecting upward from a front position. First supporting pieces 835, through which coupling rods 801 to be described later are inserted, are formed to project from the upper rear edges of the projecting plates 824 in directions toward each other.

The pair of movable plates 83 are for supporting bearings B fitted on the respective end portions of the heating roller 30, and are formed in their centers with bearing mount holes 831 into which the bearings B are fitted. The movable plates 83 are movable in forward and backward directions while being guided by corresponding pairs of guide rails 821*a* arranged above and below the rectangular holes 821 on the surfaces of the pair of side plates 82 facing each other. The heating roller 30 is so supported on the side plates 82 as to be rotatable about its central axis and movable in forward and backward directions by fitting the bearings B into the corresponding bearing mount holes 831 of the pair of movable plates 83 supported by the guide rails 821*a*.

The front end of a first coil spring 832 is mounted at a middle position of the rear edge of each movable plate 83. The rear end of the first coil spring 832 is locked in locking grooves 823*a* formed in the rear edge of the bracket 823 as shown in FIG. 4 with the movable plates 83 supported by the corresponding pairs of guide rails 821*a*. In this way, the movable plates 83 are biased backward.

The laying plate 84 has a front side thereof cut out to be recessed backward. This cutout ensures the introducing port 21 for introducing the sheet P to the nip portion N with the fixing-belt side casing 81 fitted into and coupled to the pressure-roller casing 87.

The cover member 85 has a rear plate 851 for covering the rear side of the fixing belt 50 mounted on the heating roller 30, a ceiling plate 852 extending forward from the upper edge of the rear plate 851 to cover the rear upper side of the fixing belt 50, and a bottom plate 853 extending forward from the bottom edge of the rear plate 851. This bottom plate 853 is fixed to the laying plate 84 by means of screws or the like while being placed under the lower surface of the laying plate 84, whereby the fixing-belt side casing 81 covering the fixing belt 50 can be constructed.

A specified number of through holes 854 (only one is shown in FIG. 3) are formed at suitable positions of the front end of the bottom plate 853 of such a cover member 85. The pressure-roller side casing 87 is coupled to the fixing-belt side casing 81 by driving a screw S in a later-described bottom plate 89 of the pressure-roller side casing 87 after passing the screw S through the through hole 854.

The terminal mount members 86 are for relaying power supplied to the halogen lamp 33 while supporting the halogen lamp 33. Each terminal mount member 86 has a mounting plate 861 mounted on the side plate 82 by means of screws or the like while closing the rectangular hole 821 of the side plate 82 of the fixing-belt side container 81, and a terminal mount 862 projecting outward from a substantially vertical middle position of the mounting plate 861 and extending in forward and backward directions.

A round hole 861*a* having a slightly smaller diameter than the bearing mount holes 831 of the movable plates 83 is formed in each mounting plate 861. Each end surface of the halogen lamp 33 faces the corresponding terminal mount 862 through this corresponding round hole 861*a*. Terminal pieces 862*a* corresponding to the halogen lamp 33 are mounted on each terminal mount 862 by means of screws and power is supplied to the halogen lamp 33 via these terminal pieces 862*a*.

The bearings B are respectively fitted on the opposite ends of the heating roller 30. The heating roller 30 is mounted in the fixing-belt side casing 81 by fitting the bearings B into the bearing mount holes 831 of the movable plates 83 supported between the corresponding pairs of upper and lower guide rails 821*a*.

The fixing roller 40 includes a pair of shaft tubes 43 concentrically projecting in opposite directions from the opposite ends thereof, and bearings B are mounted on these shaft tubes 43. The fixing roller 40 is so mounted in the fixing-belt side casing 81 as to be rotatable about its central axis by fitting the bearings B mounted on the shaft tubes 43 into the bearing mount holes 822 of the side plates 82.

The pressure-roller side casing 87 includes a pair of left and right side plates 88, the bottom plate 89 spanning between the bottom edges of the pair of side plates 88, a front plate 89 standing from the front edge of the bottom plate 89 and having a vertical dimensional that is about half the vertical dimension of the side plates 88, and an inclined ceiling plate 892 inclined backward toward the projecting end at the upper edge of the front plate 891.

Spacing between the inner surfaces of the pair of side plates 88 is set slightly longer than spacing between the outer surfaces of the pair of side plates 82 of the fixing-belt side casing 81 so that the pressure-roller side casing 87 is fittable on the fixing-belt side casing 81. Each side plate 88 is formed with a bearing mount hole 881 at a position before the center thereof with respect to forward and backward directions.

The pressure roller 60 includes a pair of shaft tubes 64 concentrically projecting in opposite directions from the opposite ends thereof, and bearings B are mounted on these shaft tubes 64. The pressure roller 60 is so mounted in the pressure-roller side casing 87 as to be rotatable about its central axis by fitting the bearings B mounted on the shaft tubes 64 into the bearing mount holes 881 of the side plates 88.

For example, E-rings 65 as retaining members are mounted on the shaft tubes 64 projecting out from the bearing mount holes 881 with the pressure roller 60 mounted in the pressure-roller side casing 87 via the bearings B. The mounted state of the pressure roller 60 in the pressure-roller side casing 87 is stabilized by mounting the E-rings 65.

The bottom plate 89 is formed with a long rectangular hole 89*a* extending in transverse direction at a substantially middle position with respect to forward and backward directions, and with a screw hole 89*b* at the rear end in such a manner as to face one through hole 854 of the cover member 85. The long rectangular hole 89*a* is so formed as to correspond to the introducing port 21 (see FIG. 2) for introducing the sheet P into the casing 80.

With the pressure-roller side casing 87 fitted on the fixing-belt side casing 81 such that the bottom plate 89 is held in contact with the lower surface of the bottom plate 853 of the cover member 85, the screw S is smoothly driven into the screw hole 89*b* through the through hole 854, whereby the pressure-roller side casing 87 is swingably coupled to the fixing-belt side casing 81 about the screw S. The pressure roller 60 is disposed at such a position that the outer circumferential surface thereof faces that of the fixing roller 40 via the fixing belt 50 with the pressure-roller side casing 87 coupled to the fixing-belt side casing 81.

The inclined ceiling plate 892 has a front part thereof cut in U-shape in plan view, thereby forming a cutout portion 892*a*. Second supporting pieces 892*b* set to face the first supporting pieces 835 of the fixing-belt side casing 81 stand at the rear edge of the inclined ceiling plate 892.

In order to couple the fixing-belt side casing 81 and the pressure-roller side casing 87 to each other, the coupling rods 801 are inserted through through holes formed in the first and second supporting pieces 835, 892*a* from behind with the first and second supporting pieces 835, 892*a* opposed to each other in forward and backward directions. A head portion 802 having a larger diameter larger than the coupling rod 801 is provided at the rear end of each coupling rod 801, and an annular groove 803 is formed at the front end thereof.

The second coil spring 804 is fitted in a compressed state on each coupling rod 801 inserted through the first and second supporting pieces 835, 892*a* from behind as shown in FIG. 4, and a C-ring 805 is fitted in the annular groove 803 in this state. Accordingly, the fixing-belt side casing 81 and the pressure-roller side casing 87 are biased in directions toward each other about the screw S by the biasing forces of the second coil springs 804 with the fixing-belt side casing 81 and the pressure-roller side casing 87 coupled to each other (see FIG. 4). The pressure roller 60 is pressed into contact with the fixing roller 40 via the fixing belt 50 by this biasing.

The heating roller 30 is biased in a direction away from the fixing roller 40 via the movable plates 83 and the bearings B by the biasing forces of the first coil springs 832. The fixing belt 50 is held tense by this biasing.

A pair of meander preventing bushes 301 are fixedly fitted on the opposite ends of the heating roller 30. The fixing belt 50 is prevented from meandering by tightly held between these meander preventing bushes 301.

In addition to the above construction, a thermostat 22 (one example of an excessive temperature rise preventing member as claimed) for cutting off the power supply to the halogen lamp 33 upon detecting the surface temperature of the heating roller 30 equal to or above a preset temperature, and temperature sensors 23 (temperature detecting member) for detecting the temperature of the fixing belt 50 are provided in the fixing device 20 in this embodiment.

Figure 5B:
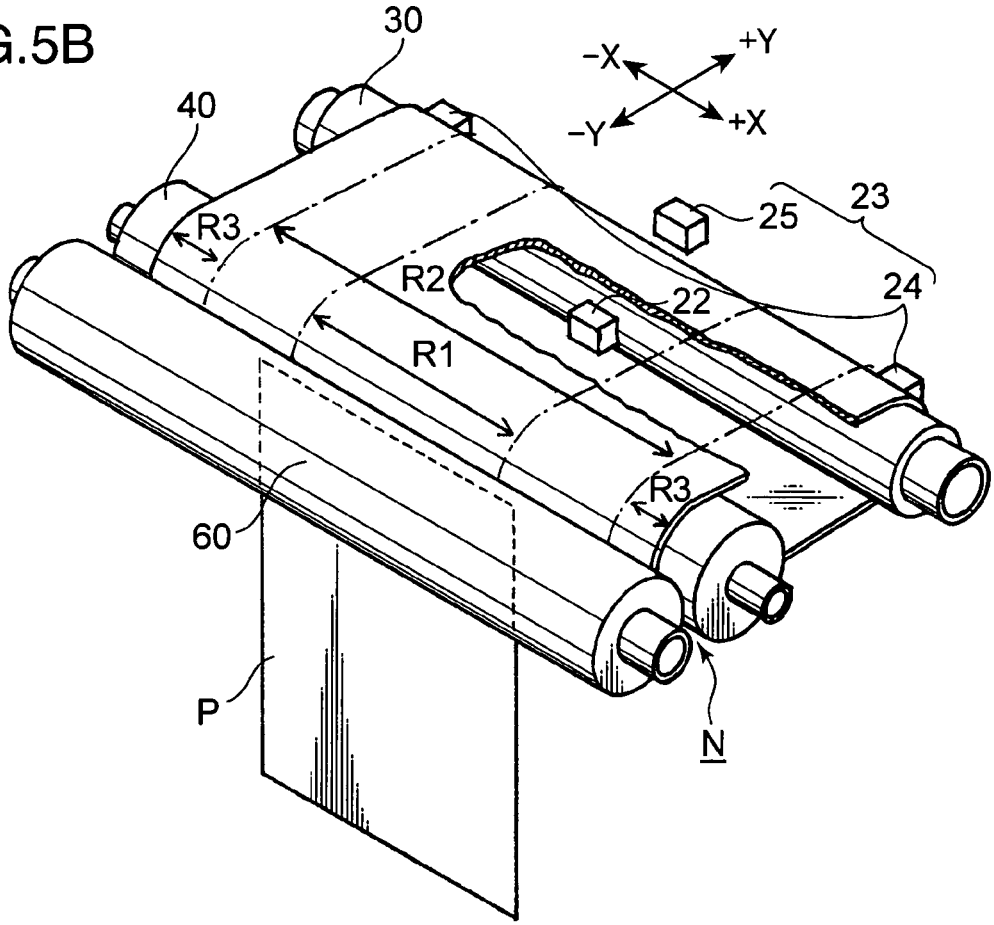

FIGS. 5A and 5B are diagrams showing one embodiment of the mounted state of the thermostat 22 and the temperature sensors 23 in the fixing device 20, wherein FIG. 5A is a front view and FIG. 5B is a perspective view partly cut away. It should be noted that directions indicated by X and Y in FIGS. 5A and 5B are similar to the case of FIG. 3 (X are transverse directions (−X: leftward direction, +X: rightward direction) and Y are forward and backward directions (−Y: forward direction, +Y: backward direction)).

The thermostat 22 is disposed such that a heat-sensitive surface thereof is held in contact with a part of the outer circumferential surface of the heating roller 30 opposite to the part where the fixing belt 50 is mounted (i.e. a part of the outer circumferential surface where the fixing belt 50 is not mounted). Here, one thermostat 22 is disposed in the longitudinal center of the heating roller 30 in this example. An arbitrary number of thermostats 22 can be disposed, i.e. two or more thermostats 22 may be disposed.

In the case of two thermostats 22, one is disposed at each of the opposite sides of the heating roller 30. In the case of three thermostats 22, one is disposed in the longitudinal center of the heating roller 30, and the remaining two are disposed at the opposite sides of the heating roller 30. As the number of the thermostats 22 increases, the temperature of the heating roller 30 can be more accurately detected and the respective longitudinal parts of the heating roller 30 can also be detected, therefore enabling the handling of the case where the heating roller 30 partially reaches an abnormally high temperature.

The thermostat 22 includes a thermostat main body 221 having a switching circuit and the like mounted therein, and a bimetal 222 provided at a side of the thermostat main body 221 facing the outer circumferential surface of the heating roller 30. A sliding-contact coating 223 having good slidability is formed on a surface of the bimetal 222 facing the heating roller 30. Very good slidability is ensured between the bimetal 222 and the outer circumferential surface of the heating roller 30 by the sliding-contact coating 223 and the fluoroplastic layer 32 formed on the outer circumferential surface of the heating roller 30. Therefore, such inconvenience as to scratch the outer circumferential surface of the heating roller 30 by the sliding contact of the bimetal 222 is unlikely to occur.

For example, PTFE (polytetrafluoroethylene) can be used for the sliding-contact coating 223. Besides, various fluoroplastics (PCTFE, PVDF, PVF, PFEP, PFA, PETFE, etc.) and various other synthetic resins having good slidability such as silicon rubber can also be used.

The temperature sensors 23 are for detecting the surface temperature of the fixing belt 50 and is disposed to face a part of the outer circumferential surface of the heating roller 30, on which the fixing belt is mounted, via the fixing belt 50. In the example shown in FIGS. 5A and 5B, the temperature sensors 23 (thermistor 25) are shown to be disposed at positions exactly opposed to the thermostat 22 with the heating roller 30 therebetween. The positions of the temperature sensors 23 are not limited thereto and any positions will do provided that the temperature sensors 23 face the fixing belt 50. Particularly, if the temperature sensors 23 are disposed within a range where the fixing belt 50 is mounted on the heating roller 30, there is no influence of the flapping of the fixing belt 50. Therefore, it is preferable for the detection of the surface temperature.

In this embodiment, two kinds of thermistors, i.e. contact thermistors 24 and a noncontact thermistor 25 are employed as the temperature sensors 23.

Each contact thermistor 24 is for detecting temperature with a temperature detecting surface thereof held in sliding contact with the outer surface of the fixing belt 50 and includes a sensor main body 241, and a contact heat-sensitive element 242 made of a specified heat-sensitive material and substantially held in sliding contact with the outer surface of the fixing belt 50 as shown in FIG. 5A. A temperature detecting circuit is built in the sensor main body 241.

A sliding-contact coating 243 similar to the aforementioned sliding-contact coating 223 of the bimetal 222 is formed on a sliding-contact surface of the contact heat-sensitive element 242 with the fixing belt 50. The sliding-contact coating 243 suppresses the damage of the outer surface of the fixing belt 50 resulting from the sliding contact with the contact thermistor 24 during the turning movement of the fixing belt 50.

On the other hand, as shown in FIG. 5A, the tough and smooth silicon rubber layer 52 is formed on the outer surface of the nickel electroformed belt 51 of the fixing belt 50, thereby processing the outer surface of the fixing belt 50 so as to be difficult to scratch. The scratch on the outer surface of the fixing belt 50 is effectively suppressed, coupled with the formation of the sliding-contact surfaces of the contact thermistors 24 with the fixing belt 50 by the sliding-contact coatings 243 as described above.

The noncontact thermistor 25 includes a sensor main body 251 having various temperature detecting circuits mounted therein, and a separated heat-sensitive element 252 provided at a side of the sensor main body 251 facing the fixing belt 50. The separated heat-sensitive element 252 senses heat radiated from the outer surface of the fixing belt 50 to detect temperature.

In this embodiment, the contact thermistor 25 is disposed to face a sheet passage area (minimum size sheet passage area R1 (see FIG. 5B): "first area" as claimed) in the nip portion P of the fixing belt 50 in the case of horizontally conveying a sheet P of minimum size (e.g. A6 size) (so that the sheet conveying direction is along the longitudinal direction of the sheet P).

On the other hand, the contact thermistors 24 are disposed to face areas (sheet non-passage areas R3: "second area" as claimed) at the opposite ends of a sheet passage area (maximum size sheet passage area R2) in the fixing belt 50 in the case of horizontally conveying a sheet P of maximum size (e.g. A3 size). In this embodiment, two contact thermistors 24 are disposed to correspond to the sheet non-passage areas R3 at the opposite left and right ends.

The noncontact thermistor 25 is disposed to correspond to the minimum size sheet passage area R1 for the following reason. Specifically, if it is tried to detect the temperature of a part of the outer surface of the fixing belt 50 to be held in contact with the sheet P, the temperature of the part of the outer surface of the fixing belt 50 where the sheet P passes can be detected regardless of which size the sheet P being passed has by disposing the noncontact thermistor 25 in correspondence with the minimum size sheet passage area R1. However, there is likelihood of damaging the part of the outer surface of the fixing belt 50 where the sheet P passes upon the sliding contact of the temperature sensor even if the silicon rubber layer 52 having good slidability is formed on the outer surface of the fixing belt 50. Therefore the noncontact thermistor 25 is employed to detect temperature in a noncontact manner.

Specifically, if an area of the fixing belt 50 where the sheet P possibly passes (i.e. maximum size sheet passage area R2) is scratched, there is likelihood of an image error in the toner image on the sheet P resulting from the scratch during the image fixing operation in the nip portion P. An occurrence of such inconvenience can be suppressed by employing the noncontact thermistor 25.

Contrary to this, there is no likelihood that the sheet P comes into contact with the sheet non-passage areas R3 of the fixing belt 50. Thus, even if the sheet non-passage areas R3 of the fixing belt 50 are partly scratched, there is no likelihood of an image error in the toner image on the sheet P resulting from the scratch during the image fixing operation in the nip portion P. Therefore, the contact thermistors 24 are employed for the sheet non-passage areas R3.

This embodiment also takes into account the positional relationship between the thermostat 22 and the temperature sensors 23. A voltage of about 100 V is normally applied to the thermostat 22. On the contrary, signal wires for deriving detection signals from the temperature sensors 23 are low-voltage systems of about 5 V. As shown in FIG. 5A, the thermostat 22 and the temperature sensors 23 are distanced from each other with the heating roller 30 located therebetween. Thus, the wire for the power of 100 V applied to the thermostat 22 and the signal wires of, e.g. 5 V for deriving the detection signals from the temperature sensors 23 come neither into proximity to nor into contact with the each other. Therefore, these two wires do not touch each other even if the insulation coating of the wire should be peeled off for a certain reason. Hence, an occurrence of such inconvenience of the malfunction or damage of the temperature sensors 23 can be securely prevented.

A power supply device 99 (see FIG. 5A) for relaying power from a commercial power source to supply it to the thermostat 22 and the halogen lamp 33 is provided at a suitable position in the apparatus main body 11. The power from this power supply device 99 is supplied to the halogen lamp 33 via the thermostat 22. An LCD (liquid crystal display) 98 (see FIG. 6) as display means is provided on an unillustrated panel arranged at a suitable position of the apparatus main body 11. When the power application to the thermostat 22 is cut off, characters representing such content are displayed on this LCD 98.

Figure 6:
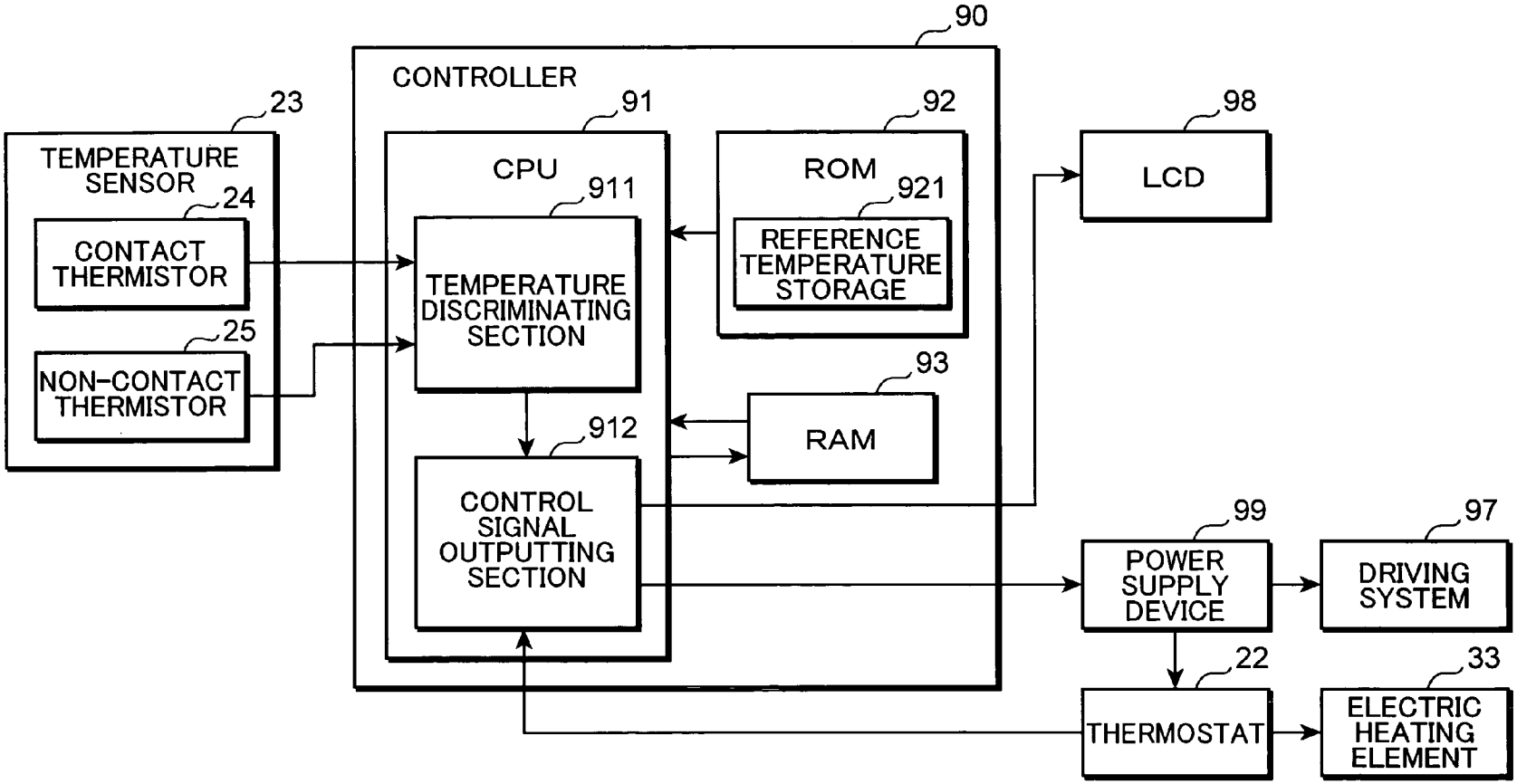
FIG. 6 is a block diagram showing the functional construction of a controller.

Next, the temperature control of the fixing belt 50 in the image forming apparatus 10 is described. A controller 90 including a microcomputer is provided at a specified position in the image forming apparatus 10, and the fixing belt 50 is controlled to have a specified temperature by this controller 90. FIG. 6 is a block diagram of the controller 90 and peripheral devices.

The controller 90 includes a CPU (central processing unit) 91 as an arithmetic processing unit, a ROM (read-only memory) as a storage device attached to the CPU 91 exclusively used for reading, and a RAM (random access memory) 93 in and from which data can be freely written and read. The ROM 92 is used to store a program for causing the controller 90 to operate, invariant data and the like. The RAM 93 is used as an area for saving temporary data temporarily generated during the control.

The CPU 91 is provided with a temperature discriminating section 911 for discriminating whether or not the temperature of the fixing belt 50 lies within a preset reference temperature range based on the detection results of the temperature sensors 23, and a control signal outputting section 912 for outputting a control signal to the power supply device 99 based on the discrimination result of the temperature discriminating section 911.

The temperature discriminating section 911 calculates an average detected temperature $T_{ave}$ of the contact thermistors 24 and the noncontact thermistor 25 in accordance with detection signals from these thermistors 24, 25, and discriminates whether or not this average detected temperature lies within the preset reference temperature range. In order to enable such a discrimination of the temperature discriminating section 911, the ROM 92 contains a reference temperature storage 921 storing the reference temperature range "T1 to T2".

The temperature discriminating section 911 judges whether or not the average detected temperature $T_{ave}$ calculated every time the detection signals from the contact thermistors 24 and the noncontact thermistor 25 are inputted lies within the reference temperature range "T1 to T2" (i.e. whether or not relationship "$T1<T_{ave}<T2$" holds). The temperature discriminating section 911 takes no particular action in the case of judgment that the average detected temperature $T_{ave}$ lies within the reference temperature range, but outputs a corresponding command signal to the control signal outputting section 912 in the case of judgment that the average detected temperature $T_{ave}$ lies outside the reference temperature range.

The control signal outputting section 912 outputs a control signal to the power supply device 99 to adjust an amount of power supplied to the halogen lamp 33 upon receiving the command signal representing that the temperature of the fixing belt 50 is outside the reference temperature range from the temperature discriminating section 911. Specifically, if the average detected temperature $T_{ave}$ is above an upper limit temperature T2, the control signal outputting section 912 outputs a control signal to the power supply device 99 to reduce the amount of power supplied to the halogen lamp 33. On the other hand, if the average detected temperature $T_{ave}$ is below a lower limit temperature T1, the control signal outputting section 912 outputs a control signal to the power supply device 99 to increase the amount of power supplied to the halogen lamp 33.

Upon abnormalities in the temperature of the fixing belt 50, the above control signals are outputted from the control signal outputting section 912 to the power supply device 99. Accordingly, the fixing belt 50 is constantly kept at a suitable temperature.

On the contrary, if the temperature of the heating roller 30 becomes abnormally high, the bimetal 222 of the thermostat 22 operated by being thermally deformed, thereby forcibly cutting off the power line to the halogen lamp 33. The power supply to the halogen lamp 33 is stopped by such forcible cutoff of the power line, whereby the abnormally high temperature state of the halogen lamp 33 is solved.

Since the operation of the image forming apparatus 10 cannot be continued when such an abnormal situation occurs, a signal representing that the thermostat 22 is shut off is directly inputted from the thermostat 22 to the control signal outputting section 912 in order to cope with such a situation. The control signal outputting section 912 outputs a control signal to the power supply device 99 in accordance with the above signal to cut off the power supplied to a driving system 97 of the image forming apparatus 10.

Simultaneously with this, the control signal outputting section 912 outputs a control signal representing the execution of a specified character output (e.g. character outputs such as "Power supply is cut off because thermostat is shut off.") to the LCD 98 in order to notify an occurrence of an abnormal state.

Figure 7:
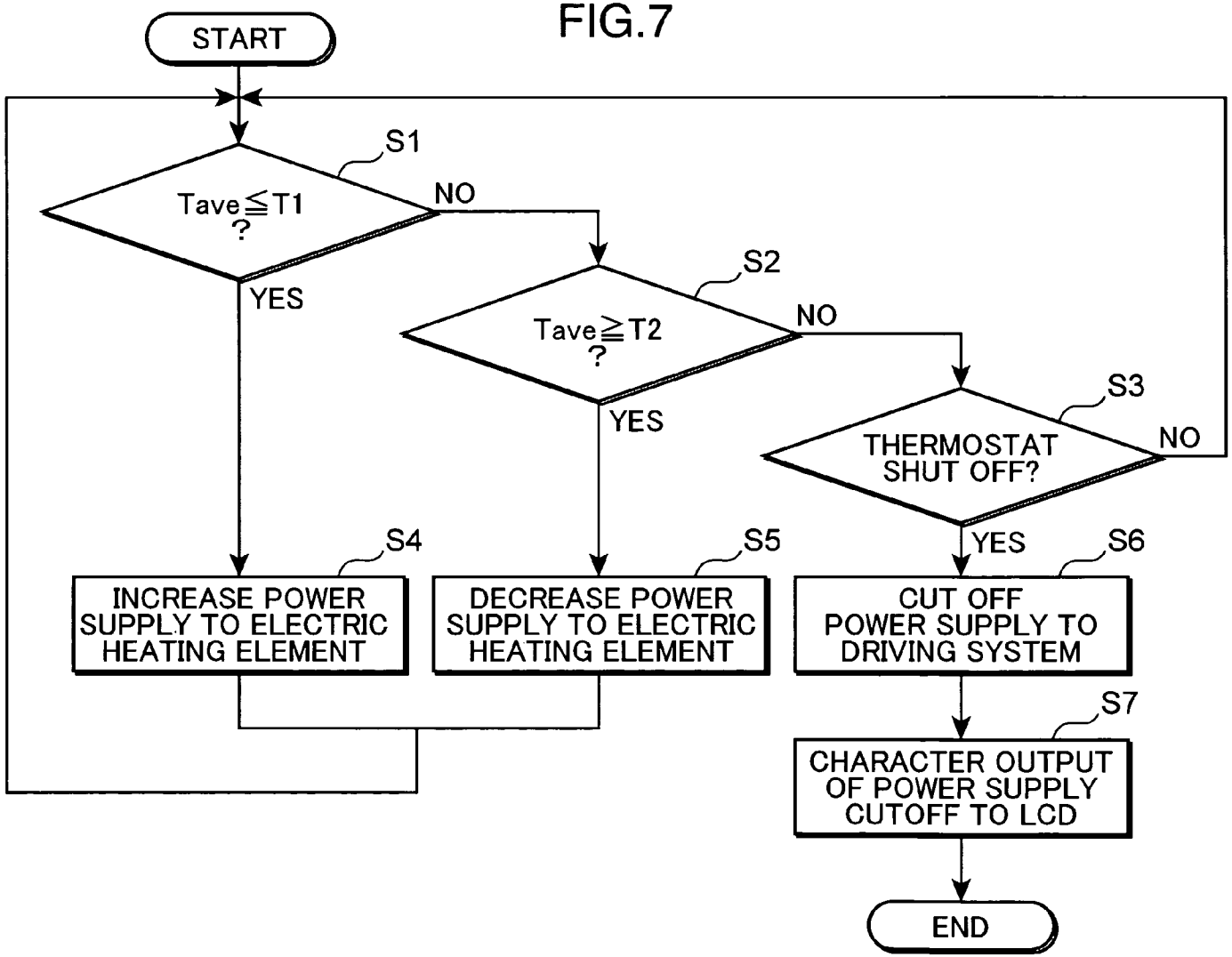
FIG. 7 is a flow chart showing one embodiment of a control flow by the controller.

FIG. 7 is a flow chart showing the control flow by the controller 90. Upon the start of the control, the temperature discriminating section 911 discriminates whether or not the average detected temperature $T_{ave}$ of the fixing belt 50 detected by the noncontact thermistor 25 and the contact thermistors 24 is equal to or below the lower limit temperature T1 (Step S1). If the average detected temperature $T_{ave}$ exceeds the lower limit temperature T1 (No in Step S1), the temperature discriminating section 911 discriminates whether or not the average detected temperature $T_{ave}$ is equal to or above the upper limit temperature T2 (Step S2). If the average detected temperature $T_{ave}$ is below the upper limit temperature T2 (No in Step S2), the control signal outputting section 912 successively discriminates whether or not the thermostat 22 has been shut off (Step S3). This routine returns to Step S1 unless the thermostat 22 has been shut off.

On the other hand, if the average detected temperature $T_{ave}$ is judged to be equal to or below the lower limit temperature T1 in Step S1 (YES in Step S1), power increased by a specified amount is supplied from the power supply device 99 to the halogen lamp 33 in accordance with a control signal from the control signal outputting section 912 (Step S4). Then, this routine returns to Step S1. If the amount of power supplied to the halogen lamp 33 is increased to increase an amount of heat generated by the halogen lamp 33 and, thereby, the average detected temperature $T_{ave}$ exceeds the lower limit temperature T1 (NO in step S1), the temperature increase of the halogen lamp 33 is stopped by no longer performing Step S4.

If the average detected temperature $T_{ave}$ is judged to be higher than the upper limit temperature T2 in Step S2 (YES in Step S2), the amount of power supplied to the halogen lamp 33 is decreased by a specified amount (Step S5). Then, this routine returns to Step S1. If the average detected temperature $T_{ave}$ becomes below the upper limit T2 in Step S2, Step S3 is performed.

If the thermostat 22 is judged to have been shut off by the control signal outputting section 912 in Step S3 (YES in Step S3), the heat generation of the halogen lamp 33 receiving the power supply via the thermostat 22 is stopped as a matter of course. Subsequently, the power supply to the driving system 97 is cut off (Step S6) and then the LCD 98 performs a character output to the effect that the power supply is cut off in accordance with a control signal from the control signal outputting section 912 (Step S7).

As described in detail above, the fixing device 20 according to this embodiment includes the heating roller 30 internally fitted with the halogen lamp 33 for generating heat upon the power supply, the pressure roller 60 disposed at the specified distance to the heating roller 30, the fixing roller 40 as a facing member disposed in proximity to the surface of the pressure roller 60 facing the heating roller 30, and the endless fixing belt 50 mounted on the fixing roller 40 and the heating roller 30 and forming the nip portion N by being pressed into contact with the pressure roller 60 at the position of the fixing roller 40. By the turning movement of the fixing belt 50, the toner image on the sheet P fed to the nip portion N is fixed by the heat supplied from the halogen lamp 33 via the heating roller 30 and the fixing belt 50.

With such a construction, since the fixing belt 50 turns between the heating roller 30 and the fixing roller 40 by driving the pressure roller 60 to rotate with the heating roller 30 heated by the heat generated by the halogen lamp 33, the fixing belt 50 is uniformly heated at a specified temperature by the heat transfer from the heating roller 30. When the sheet P having the toner image transferred thereto is fed to the nip portion N with the fixing belt 50 heated to the specified temperature, the toner particles are heated and melted by the heat from the fixing belt 50, thereby performing the image fixing operation.

The fixing device 20 includes the temperature sensors 23 for detecting the surface temperature of the fixing belt 50. These temperature sensors 23 are disposed to face the part of the outer circumferential surface of the heating roller 30, where the fixing belt 50 is mounted, via the fixing belt 50. Thus, temperature at the outer surface of the fixing belt 50 can be directly more properly detected and the surface temperature of the fixing belt 50 can be more properly controlled based on the detection results as compared to the case where the temperature sensors 23 are disposed to face the outer circumferential surface of the heating roller 30 as in the prior art. Therefore, a specified level of the fixing property of the toner particles to the sheet P can be constantly ensured.

The fixing device 20 also includes the thermostat 22 for cutting off the power supply to the halogen lamp 33 upon detecting that the surface temperature of the heating roller 30 is equal to or above the preset temperature. If the temperature of the heating roller 30 becomes abnormally high for a certain reason, the power supply to the halogen lamp 33 is cut off by the operation of the thermostat 22, whereby unexpected accidents caused by an excessively high temperature of the heating roller 30 can be avoided. This thermostat 22 is disposed to face the part of the heating roller 30 where the fixing belt 50 is not mounted. Thus, the temperature of the heating roller 30 can be directly and precisely detected by the thermostat 22 as compared to the case where the fixing belt 50 is present between the heating roller 30 and the thermostat 22.

The temperature sensors 23 are disposed to face the part of the outer circumferential surface of the heating roller 30, where the fixing belt 50 is mounted, via the fixing belt 50, whereas the thermostat 22 is disposed to face the part of the outer circumferential surface of the heating roller 30 where the fixing belt 50 is not mounted. By this arrangement, the temperature sensors 23 and the thermostat 22 are in such a positional relationship as to be distanced from each other with the heating roller 30 located therebetween.

An instrumentation power of low voltage (e.g. 5V) is normally supplied to the temperature sensors 23, whereas a commercial electric power of, e.g. 100 V is normally supplied to the thermostat 22 since the thermostat 22 is for forcibly cutting off a current as a breaker does. By having the above positional relationship, these wiring systems having different voltage levels can be wired while being distanced from each other. Accordingly, the secure temperature detections by the temperature sensors 23 can be ensured without the instrumentation power of low voltage being influenced by the commercial electric power of high voltage.

Further, the contact thermistors 24 and the noncontact thermistor 25 are employed as the temperature sensors 23. Since being disposed in correspondence with the minimum size sheet passage area R1 of the fixing belt 50 that is a sheet passage area for minimum size sheets P, the noncontact thermistor 25 can constantly detect the temperature of the fixing belt 50 at a passing position of the sheet P regardless of the size of the sheet P to be passed through the nip portion N. Since the temperature detection in such a sheet passage area is performed by the noncontact thermistor 25, the outer surface of the fixing belt 50 is not scratched and, hence, an occurrence of an image error in the fixed toner image resulting from the scratch can be securely prevented.

Contrary to this, the contact thermistors 24 are disposed in sliding contact with the sheet non-passage areas R3 of the fixing belt 50 outside the maximum size sheet passage area R2 that is the sheet passage area of maximum size sheets P. Since the areas R3 are the lateral parts of the fixing belt 50 where no sheet P passes, the temperature of the fixing belt 50 can be precisely detected. Even if the contact thermistors 24 are held in sliding contact with the outer surface of the fixing belt 50, no sheet P passes these sliding-contact positions located in the sheet non-passage areas R3. Accordingly, no image error is caused in the fixed image even if these parts of the fixing belt 50 should be scratched.

The thermostat 22 is in contact with the outer circumferential surface of the heating roller 30. Thus, the surface temperature of the heating roller 30 can be more precisely detected as compared to the case where the thermostat 22 is disposed to face the outer circumferential surface of the heating roller 30 in a noncontact manner.

Further, the smooth sliding-contact coating 223 having a low friction coefficient is formed on the sliding-contact surface of the thermostat 22 with the heating roller 30, and the fluoroplastic layer 32 having a low friction efficient is formed on the outer circumferential surface of the heating roller 30. Thus, the sliding-contact resistance of the thermostat 22 by the contact with the outer circumferential surface of the rotating heating roller 30 is suppressed to quite low, therefore an occurrence of abrasion powder by the abrasion of the thermostat 22 and the heating roller 30 can be suppressed.

The present invention is not limited to the foregoing embodiment and also embraces the following contents.

(1) In the foregoing embodiment, the fixing device 20 according to the present invention is applied to the image forming apparatus 10 as a copier. The present invention is also applicable to facsimile machines, printers and the like.

(2) In the foregoing embodiment, the fixing belt 50 is mounted to stretch between the pair of rollers (heating roller 30 and fixing roller 40) opposed to each other. Instead, the fixing belt 50 may be mounted on three or more rollers.

(3) In the foregoing embodiment, the halogen lamp 33 is employed as an electric heating element for heating the heating roller 30. Instead, another kind of electric heating element such as a Nichrome wire may be used.

(4) In the foregoing embodiment, two kinds of temperature sensors, i.e. the contact thermistors 24 and the noncontact thermistor 25 are employed as the temperature sensors 23. Instead, only either one of them may be employed. For example, noncontact thermistors 25 may be also disposed in correspondence with the sheet non-passage areas R3. Further, the number of the temperature sensors 23 is suitably set depending on the situation, and is not limited to a combination of two contact thermistors 24 and one thermistor 25 as in the foregoing embodiment.

(5) In the foregoing embodiment, the temperature sensors 23 are disposed to face the thermostat 22 with the heating roller 30 located therebetween. The present invention is not limited to this arrangement, and the temperature sensors 23 may be disposed at any positions where they can detect the surface temperature of the fixing belt 50.

Figure 8:
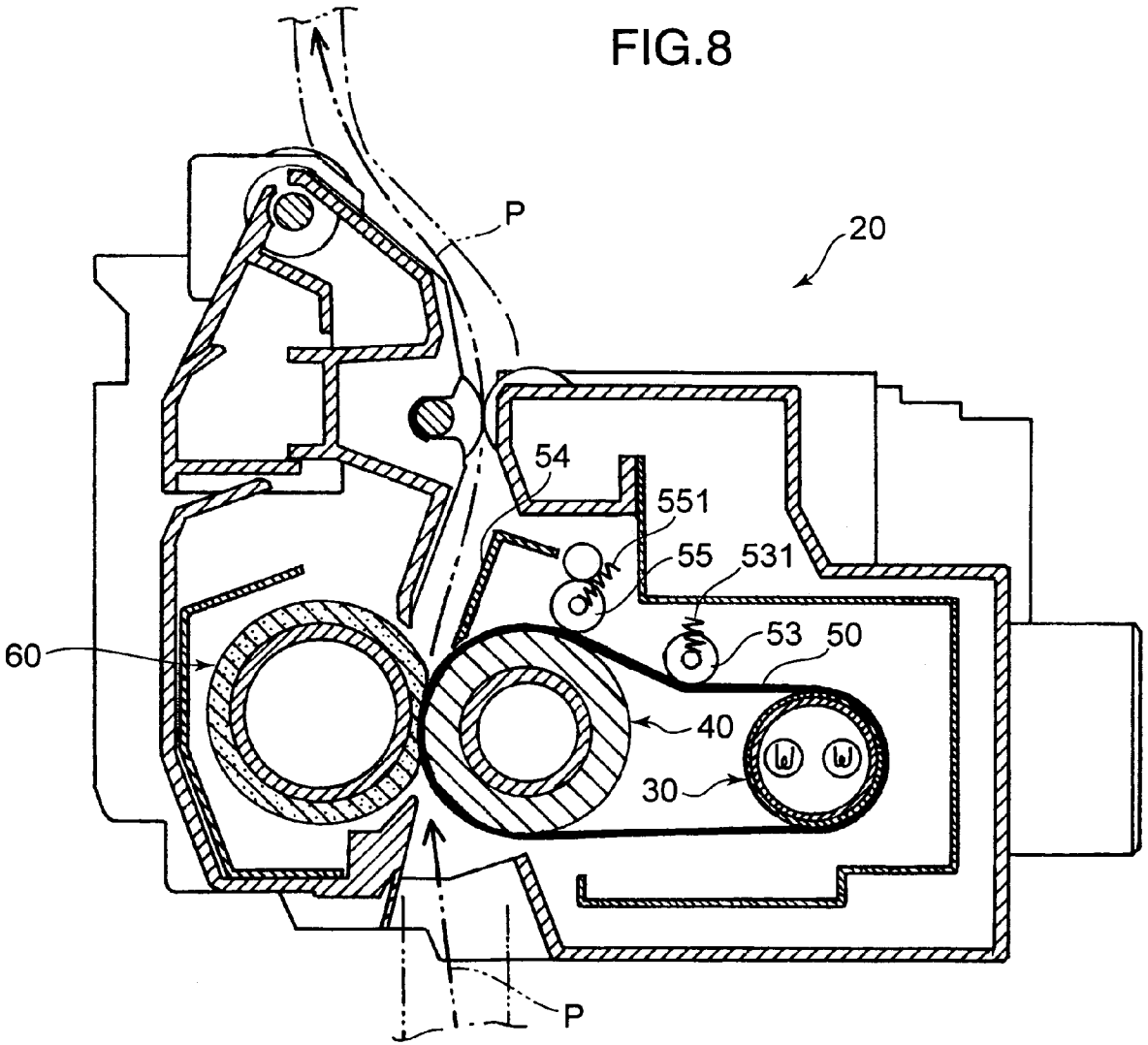
FIG. 8 is a section showing a state where a tension roller and a cleaning roller are applied to a fixing belt in the fixing device.

(6) In the foregoing embodiment, a tension roller 53 and a cleaning roller 55 may be provided as shown in FIG. 8. The tension roller 53 is disposed at a position above the fixing belt 50 to tighten the fixing belt 50. The cleaning roller 55 is disposed to clean the outer surface of the fixing belt 50 between the tension roller 53 and the separating plate 54 for separating the sheet P coming out of the nip portion N from the fixing belt 50. The tension roller 53 is pressed against the outer surface of the fixing belt 50 by a biasing force of a coil spring 531, and the cleaning roller 55 is also pressed against the outer surface of the fixing belt 50 by a biasing force of a coil spring 551.

The tension roller 53 is freely rotatable about its central axis, whereas the cleaning roller 55 is driven to rotate by an unillustrated drive motor. Thus, toner particles and the like attached to the outer surface of the fixing belt 50 can be removed.

By employing these tension roller 53 and cleaning roller 55, the fixing belt 50 can be constantly kept tense and the outer surface thereof can be kept clean.

Figure 9:
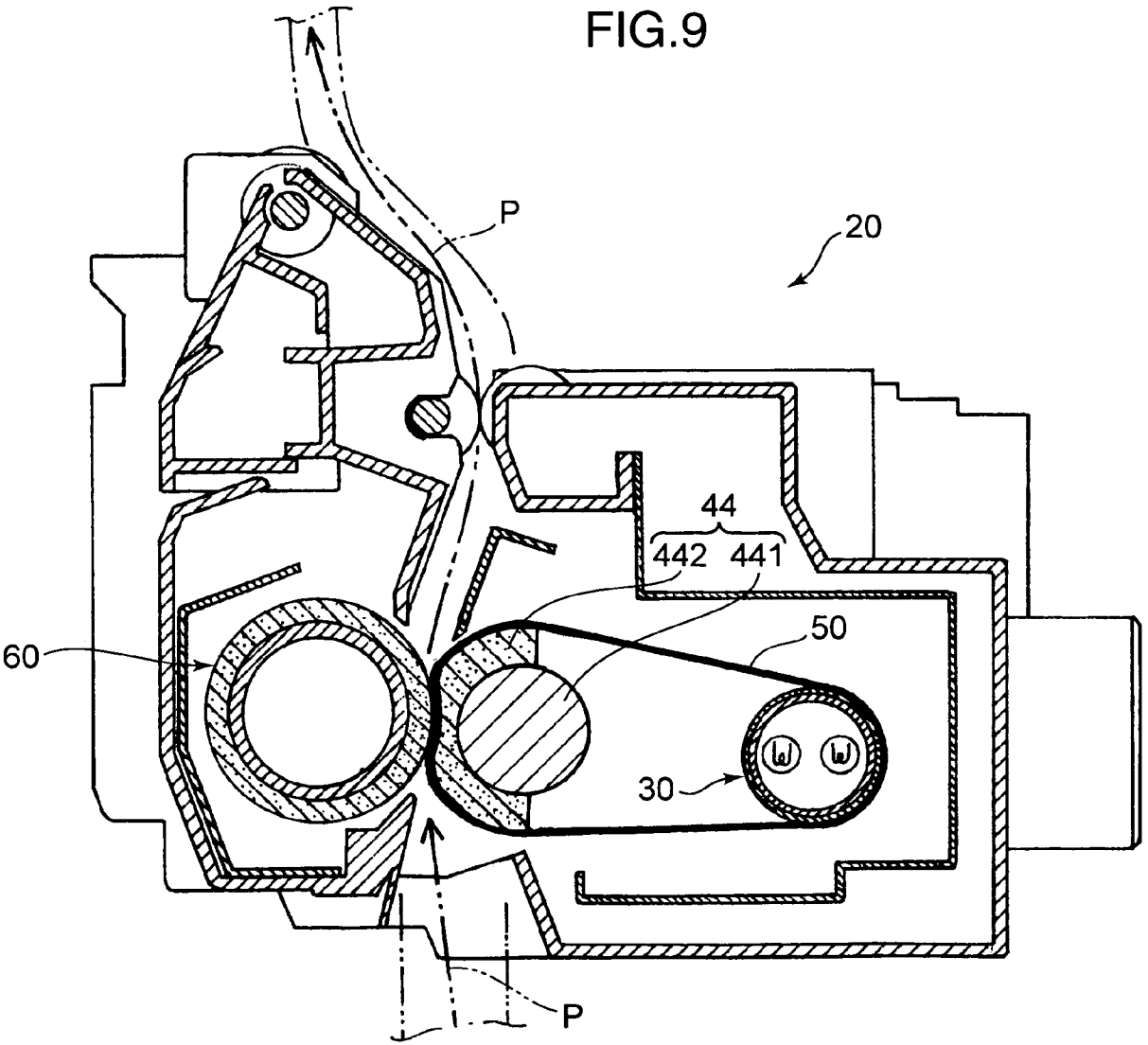
FIG. 9 is a section showing a state where a fixing pad member is used instead of a fixing roller in the fixing device.

(7) In the foregoing embodiment, a fixing pad member 44 may be employed instead of the fixing roller 40 as shown in FIG. 9. The fixing pad member 44 is comprised of a cylindrical core member 441 corresponding to the fixing roller core 41, and a fixing pad 442 disposed to the left of this core member 441 in FIG. 9. The fixing pad 442 is made of soft material such as rubber foam or synthetic resin foam, and a part thereof facing the pressure roller 60 is pressed against the outer circumferential surface of the pressure roller 60 and is resiliently compressed toward the center of the core member 441.

The fixing belt 50 turns between the heating roller 30 and the fixing pad member 442 by the driving rotation of the pressure roller 60 while being mounted on the fixing pad 442.

By employing the fixing pad member 44 instead of the fixing roller 40 in this way, the number of parts can be reduced by obviating the need for bearing members and the like, which can accordingly contribute to a cost reduction of the apparatus.

The aforementioned specific embodiments mainly embrace features of the inventions having the following constructions.

A fixing device according to one aspect of the present invention for fixing a toner image by giving heat to a transfer material having the toner image transferred thereto, comprises a heat source for generating heat upon receiving the supply of power; a heating roller having the heat source mounted therein; a pressure roller disposed at a specified distance to the heating roller; a facing member disposed to face the heating roller; an endless fixing belt mounted on the facing member and the heating roller and pressed into contact with the pressure roller to form a nip portion; a temperature detecting member disposed to face the outer surface of the fixing belt for the detection of the surface temperature of the fixing belt; and an excessive temperature increase preventing member disposed to face a part of the outer circumferential surface of the heating roller where the fixing belt is not mounted for detecting the surface temperature of the heating roller and cutting off the power supply to the heat source when the surface temperature rises to or above a preset temperature.

An image forming apparatus according to another aspect of the present invention comprises an image forming unit for performing an operation of transferring a toner image to a transfer material, and a fixing unit for fixing the toner image by giving heat to the transfer material, the fixing unit having the construction of the above fixing device.

With such a construction, the fixing belt turns between the heating roller and the facing member with the heating roller heated by the heat generated by the heat source, therefore the fixing belt is uniformly heated to a specified temperature by the heat transfer from the heating roller. By conveying the transfer material having the toner image transferred thereto toward the nip portion between the fixing belt and the pressure roller with the fixing belt heated to the specified temperature, toner particles are heated and melted by receiving the heat from the fixing belt, whereby an image fixing operation is performed.

The fixing device is provided with the temperature detecting member for detecting the surface temperature of the fixing belt, and this temperature detecting member is disposed to face the outer surface of the fixing belt. Thus, the surface temperature of the fixing belt can be directly more precisely detected as compared to the case where the temperature detecting member indirectly detects the temperature of the fixing belt by being disposed to face the outer circumferential surface of the heating roller as in the prior art. The temperature of the fixing belt can be controlled based on this precise detection result, therefore the stable fixing property of the toner particles to the transfer material can be constantly ensured.

The fixing device also includes the excessive temperature increase preventing member for cutting off the power supply to the heat source when the surface temperature of the heating roller is detected to be equal to or above the preset temperature. Thus, if the temperature of the heating roller becomes abnormally high, the power supply to the heat source is cut off by the operation of the excessive temperature increase preventing member, whereby unexpected accidents caused by an excessively high temperature of the heating roller can be avoided. This excessive temperature increase preventing member is disposed to face the part of the heating roller where the fixing belt is not mounted. Thus, the temperature of the heating roller can be directly and precisely detected by the excessive temperature increase preventing member as compared to the case where the fixing belt is present between the heating roller and the excessive temperature increase preventing member.

In the above construction, the temperature detecting member and the excessive temperature increase preventing member are preferably arranged such that the heating roller is located therebetween.

With such a construction, a normally low-voltage wiring system for the temperature detecting member and a normally high-voltage wiring system for the excessive temperature increase preventing member can be wired while being distanced from each other. Accordingly, the secure temperature detection by the temperature detecting member can be ensured without low-voltage instrumentation power being influenced by high-voltage commercial electric power.

In the above construction, it is preferable that the temperature detecting member is disposed to face a first area of the fixing belt that comes into contact with a transfer material when the transfer material of minimum size passes the nip portion, and that a detecting surface of the temperature detecting member is not in contact with the fixing belt.

Alternatively, it is preferable that the temperature detecting member is disposed to face a second area of the fixing belt that does not come into contact with a transfer material when the transfer material of maximum size passes the nip portion, and that a detecting surface of the temperature detecting member is in contact with the fixing belt.

Further alternatively, it is preferable that the temperature detecting member is disposed to face a first area of the fixing belt that comes into contact with a transfer material when the transfer material of minimum size passes the nip portion and a second area of the fixing belt that does not come into contact with a transfer material when the transfer material of maximum size passes the nip portion, and that detecting surface of the temperature detecting member is not in contact with the fixing belt in the first area while being in contact with the fixing belt in the second area.

With such a construction, since the temperature detecting member is disposed to face the first area in a noncontact manner, there is no likelihood of scratching the outer surface of the fixing belt by a turning movement of the fixing belt and there is also no likelihood of an image error in the toner image on the transfer material resulting from the scratches. By such arrangement of the temperature detecting member, the temperature of a substantially widthwise middle part of the fixing belt, which is thought to represent the temperature of the fixing belt, can be detected.

On the contrary, the temperature detecting member is disposed such that the detecting surface thereof is in contact with the fixing belt in the second area. However, since transfer materials do not come to be located in this area, there is no influence on the transfer materials even if the fixing belt is scratched.

If the temperature detecting members are disposed to face both the first and second areas, the fixing belt can be controlled to a more uniform temperature based on the detection results of these temperature detecting members.

In the above construction, the temperature detecting member is preferably disposed to face a part of the fixing belt mounted on the heating roller.

With such a construction, the temperature of the fixing belt can be detected in a stable state by the temperature detecting member without causing any such inconvenience that the temperature detecting member collides with the fixing belt because of the flapping of the fixing belt. Further, if the temperature detecting member is disposed at a specified clearance to the fixing belt (i.e. if the detecting surface is not in contact with the fixing belt), this clearance can be held constant.

In the above construction, the excessive temperature increase preventing member is preferably held in contact with the outer circumferential surface of the heating roller. With such a construction, the temperature at the outer circumferential surface of the heating roller can be more accurately detected as compared to the case where the excessive temperature increase preventing member is disposed to face the outer circumferential surface of the heating roller in a noncontact manner.

In the above construction, either one or both of the contact surface of the excessive temperature increase preventing member with the heating roller and the outer circumferential surface of the heating roller are preferably coated with a coating having good slidability. Since sliding-contact resistance therebetween is held low in this way, the production of abrasion powder caused by the abrasion of these surfaces can be suppressed.

In the above construction, the facing member may be a fixing roller which is rotatable about its central axis and on which the fixing belt is mounted. With such a construction, the fixing belt can smoothly turn between the heating roller and the fixing roller by the rotation of the fixing roller about its central axis.

In the above construction, the facing member may be a nonrotational fixing pad on which the fixing belt is mounted while being held in sliding contact. With such a construction, the fixing belt smoothly turns between the heating roller and the fixing roller while the sheet is softly sandwiched by the elastic deformation of the fixing pad between the heating roller and the fixing pad with the fixing belt located between the sheet and the fixing pad.

This application is based on patent application No. 2006-030199 filed in Japan, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device for fixing a toner image by giving heat to a transfer material having the toner image transferred thereto, comprising:

a heat source for generating heat upon receiving a supply of power;

a heating roller having the heat source mounted therein;

a pressure roller disposed at a specified distance to the heating roller;

a facing member disposed to face the heating roller;

an endless fixing belt mounted on the facing member and the heating roller and pressed into contact with the pressure roller to form a nip portion;

a temperature detecting member disposed to face the outer surface of the fixing belt for the detection of the surface temperature of the fixing belt; and an excessive temperature increase preventing member disposed to face a part of the outer circumferential surface of the heating roller where the fixing belt is not mounted for detecting the surface temperature of the heating roller and cutting off the power supply to the heat source when the surface temperature rises to or above a preset temperature.

2. A fixing device according to claim 1, wherein the temperature detecting member and the excessive temperature increase preventing member are arranged such that the heating roller is located therebetween.

3. A fixing device according to claim 1, wherein the temperature detecting member is disposed to face a first area of the fixing belt that comes into contact with a transfer material when the transfer material of minimum size passes the nip portion, and a detecting surface of the temperature detecting member is not in contact with the fixing belt.

4. A fixing device according to claim 1, wherein the temperature detecting member is disposed to face a second area of the fixing belt that does not come into contact with a transfer material when the transfer material of maximum size passes the nip portion, and a detecting surface of the temperature detecting member is in contact with the fixing belt.

5. A fixing device according to claim 1, wherein:

the temperature detecting member is disposed to face a first area of the fixing belt that comes into contact with a transfer material when the transfer material of minimum size passes the nip portion and a second area of the fixing belt that does not come into contact with a transfer material when the transfer material of maximum size passes the nip portion, and a detecting surface of the temperature detecting member is not in contact with the fixing belt in the first area while being in contact with the fixing belt in the second area.

6. A fixing device according to claim 1, wherein the temperature detecting member is disposed to face a part of the fixing belt mounted on the heating roller.

7. A fixing device according to claim 1, wherein the excessive temperature increase preventing member is held in contact with the outer circumferential surface of the heating roller.

8. A fixing device according to claim 7, wherein either one or both of the contact surface of the excessive temperature increase preventing member with the heating roller and the outer circumferential surface of the heating roller are coated with a coating having good slidability.

9. A fixing device according to claim 1, wherein the facing member is a fixing roller which is rotatable about its central axis and on which the fixing belt is mounted.

10. A fixing device according to claim 1, wherein the facing member is a nonrotational fixing pad on which the fixing belt is mounted while being held in sliding contact.

11. An image forming apparatus, comprising:

an image forming unit for performing an operation of transferring a toner image to a transfer material, and a fixing unit for fixing the toner image by giving heat to the transfer material, the fixing unit including:

a heat source for generating heat upon receiving a supply of power;

a heating roller having the heat source mounted therein;

a pressure roller disposed at a specified distance to the heating roller;

a facing member disposed to face the heating roller;

an endless fixing belt mounted on the facing member and the heating roller and pressed into contact with the pressure roller to form a nip portion;

a temperature detecting member disposed to face the outer surface of the fixing belt for the detection of the surface temperature of the fixing belt; and an excessive temperature increase preventing member disposed to face a part of the outer circumferential surface of the heating roller where the fixing belt is not mounted for detecting the surface temperature of the heating roller and cutting off the power supply to the heat source when the surface temperature rises to or above a preset temperature.

12. An image forming apparatus according to claim 11, wherein the temperature detecting member and the excessive temperature increase preventing member are arranged such that the heating roller is located therebetween.

13. An image forming apparatus according to claim 11, wherein the temperature detecting member is disposed to face a first area of the fixing belt that comes into contact with a transfer material when the transfer material of minimum size passes the nip portion, and a detecting surface of the temperature detecting member is not in contact with the fixing belt.

14. An image forming apparatus according to claim 11, wherein the temperature detecting member is disposed to face a second area of the fixing belt that does not come into contact with a transfer material when the transfer material of maximum size passes the nip portion, and a detecting surface of the temperature detecting member is in contact with the fixing belt.

15. An image forming apparatus according to claim 11, wherein:

the temperature detecting member is disposed to face a first area of the fixing belt that comes into contact with a transfer material when the transfer material of minimum size passes the nip portion and a second area of the fixing belt that does not come into contact with a transfer material when the transfer material of maximum size passes the nip portion, and a detecting surface of the temperature detecting member is not in contact with the fixing belt in the first area while being in contact with the fixing belt in the second area.

16. An image forming apparatus according to claim 11, wherein the temperature detecting member is disposed to face a part of the fixing belt mounted on the heating roller.

17. An image forming apparatus according to claim 11, wherein the excessive temperature increase preventing member is held in contact with the outer circumferential surface of the heating roller.

18. An image forming apparatus according to claim 17, wherein either one or both of the contact surface of the excessive temperature increase preventing member with the heating roller and the outer circumferential surface of the heating roller are coated with a coating having good slidability.

19. An image forming apparatus according to claim 11, wherein the facing member is a fixing roller which is rotatable about its central axis and on which the fixing belt is mounted.

20. An image forming apparatus according to claim 11, wherein the facing member is a nonrotational fixing pad on which the fixing belt is mounted while being held in sliding contact.

* * * * *